United States Patent [19]

Hollingsworth

[11] Patent Number: 4,730,572

[45] Date of Patent: Mar. 15, 1988

[54] RUDDERLESS CIRCULAR BOAT

[75] Inventor: Charles R. Hollingsworth, Evansville, Ind.

[73] Assignee: Roundabout Boats, Inc., Evansville, Ind.

[21] Appl. No.: 874,294

[22] Filed: Jun. 13, 1986

[51] Int. Cl.[4] ..... B63B 1/20

[52] U.S. Cl. ..... 114/283; 114/152; 114/346

[58] Field of Search ..... 114/346, 271, 283, 284, 114/152; 441/73, 65, 67

[56] References Cited

U.S. PATENT DOCUMENTS

| | | | |
|---|---|---|---|
| 2,821,948 | 2/1958 | Harkson | 114/283 X |
| 2,996,030 | 8/1961 | Lornson | 114/283 |
| 3,452,698 | 7/1969 | Wilson | 114/271 |
| 3,718,111 | 2/1973 | Vecchio | 114/346 X |
| 4,561,664 | 12/1985 | Cashmere | 441/65 X |

*Primary Examiner*—Sherman D. Basinger

*Attorney, Agent, or Firm*—Dressler, Goldsmith, Shore, Sutker & Milnamow, Ltd.

[57] ABSTRACT

A circular boat comprising a pair of generally dish-shaped members connected together in opposed relationship. A cockpit region is provided abeam of the boat and an outboard motor is operationally but fixedly mounted in a motor well behind the cockpit region and within the perimeter of the boat. A pair of flat skis is rigidly mounted to the bottom of the boat hull. The hull bottom is also provided with a planar section which defines a forward planing surface substantially coplanar with the skis. When sufficient forward speed is reached, the boat rises and planes on the skis. Steering is achieved by shifting of weight by the boat operator over one or the other of the skis, the boat being rudderless. The boat is also equipped with fins projecting laterally from the hull bottom whereby the operator may step onto the hull deck while the boat is underway to dip a fin into the water and thereby cause the boat to make a turn.

5 Claims, 8 Drawing Figures

RUDDERLESS CIRCULAR BOAT

TECHNICAL FIELD

This invention relates to pleasure boats and, more particularly, to a circular rudderless boat.

BACKGROUND OF THE INVENTION

Pleasure boats, and especially motor-powered boats, have heretofore been provided in a multitude of hull designs. Such craft may range anywhere from one or two-passenger rafts or dinghies carrying an outboard motor to luxurious speedboats and cruisers.

It is likewise known to provide powered pleasure boats having circular, substantially circular or dish-shaped hulls. A prior art patent search relating to circular boat structures revealed the following representative patents: U.S. Pat. Nos. 2,791,981, 2,826,163, 2,849,978, 3,335,436, 3,382,513, 3,391,669, 3,493,982, 3,710,408, 3,548,428 and 4,273,060, French Pat. Nos. 2,366,988 and 2,526,395, Belgian Pat. No. 549,025, and British Pat. No. 2,040,830. Of the foregoing, U.S. Pat. No. 3,382,513 shows a basic circular hull, U.S. Pat. No. 2,826,163 and Belgian Pat. No. 549,025 show the combination of an outboard motor with a circular hull, and U.S. Pat. No. 2,849,978 shows a submersible circular boat having a depth regulating blade attached to fins.

None of the prior patents listed above show or suggest a circular boat having a planing hull with skis attached to the hull, or a mode of operation and control similar to that embodied in the subject invention, however.

SUMMARY OF THE INVENTION

The present invention provides a pleasure boat having a circular hull with skis connected to the hull and extending rearwardly therefrom. The boat is powered by an outboard motor mounted to the hull, and rides on the skis when a planing speed is reached. The skis also function as the means for turning and controlling the direction of travel, the boat being otherwise rudderless.

Briefly, the invention comprises a pair of opposed, dish-like hull members, preferably molded from a durable plastic such as fiberglass-reinforced resins or acrylonitrile-butadiene-styrene (ABS) resins. The dish-like hull members are connected together to provide, respectively, the bottom and deck of the boat. A pair of skis, likewise preferably molded of a similar plastic material, is rigidly connected to the underside of the hull, preferably to laterally spaced support columns depending integrally from the boat bottom. The skis extend rearwardly of the boat from amidship, i.e., beginning substantially at the widest portion of the hull. The boat is provided with a centrally located cockpit region and a motor well rearwardly of the cockpit but within the periphery of the hull. An outboard motor is rigidly mountable to the boat so that the same is in a fixed position and not able to pivot in a horizontal plane. Steering of the boat is accomplished by the cockpit occupant or occupants shifting weight over one or the other of the skis.

For sharper turns, or turns at a very slow speed, a pair of lateral fins can be provided. These fins are mounted approximately amidship and on the freeboard section of the hull. By appropriately shifting his weight thereover, the boat operator may submerge the lateral fin in whole or in part while the boat is moving, and thus cause the boat to make a sharp and abrupt turn.

Additional features of the invention include flotation material within the hull to render the boat virtually unsinkable, plural and relatively small keels integral with the hull bottom and/or the skis for enhanced directional stability.

The inventive boat may be driven at any desired speed ranging from slow to moderate to quite fast, up to about 60 miles per hour, depending upon the motor that is installed. Thus, the boat may be utilized for a wide variety of activities, such as, speedboating, racing, fishing, towing water skiers or serving as a tender for larger vessels. Operation of the boat is relatively easy to learn, and is entertaining. The boat is effectively controllable with minimum effort. At the same time, the boat is lightweight, highly reliable and safe.

Numerous other advantages and features of the present invention will become readily apparent from the following detailed description of the invention, from the claims, and from the accompanying drawings.

BRIEF DESCRIPTION OF THE DRAWINGS

In the accompanying drawings forming a part of the specification, and in which like numerals are employed to designate like parts throughout the same.

DETAILED DESCRIPTION OF THE INVENTION

Figure 1:
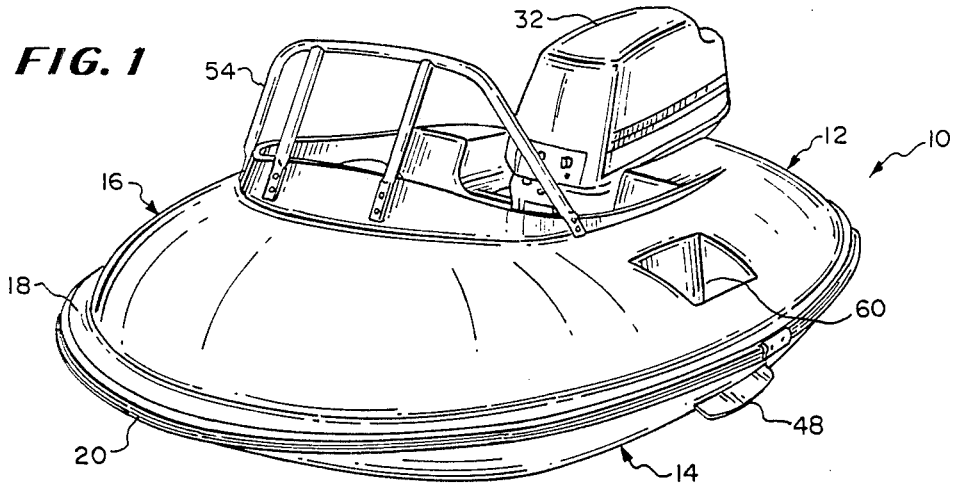
FIG. 1 is a front perspective view of a circular boat embodying the principles of the invention.
Figure 2:
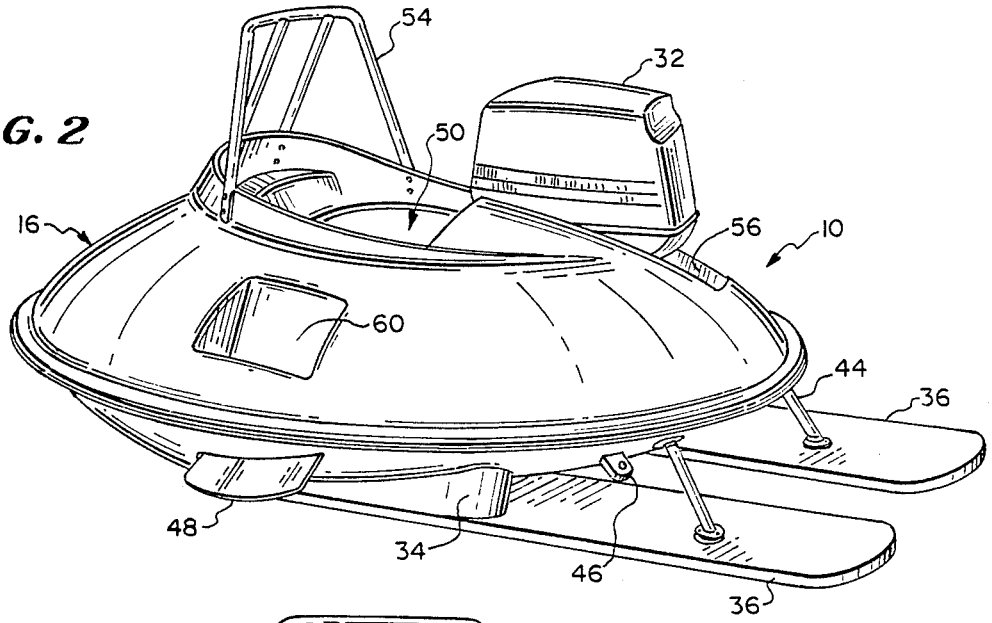
FIG. 2 is a side perspective view thereof.

Referring with greater particularity to the FIGURES, a circular ski boat 10 embodying the principles of the invention is shown. Boat 10 comprises a hull 12 having a bottom portion 14 and a deck portion 16, each of said portions comprising a circular and generally dish-like member as illustrated. Bottom portion 14 and deck portion 16 are connected together around their peripheries in opposed relationship by suitable means such as metal connectors, bonding, adhesives, clamps, or the like. Preferably, the portions 14 and 16 are molded from well-known durable plastics so that any of the mentioned forms of connection may be readily employed. In the embodiment illustrated, a channel-shaped member 18 circumscribes the hull 12 and retains therein a resilient bump rail 20.

Figure 4:
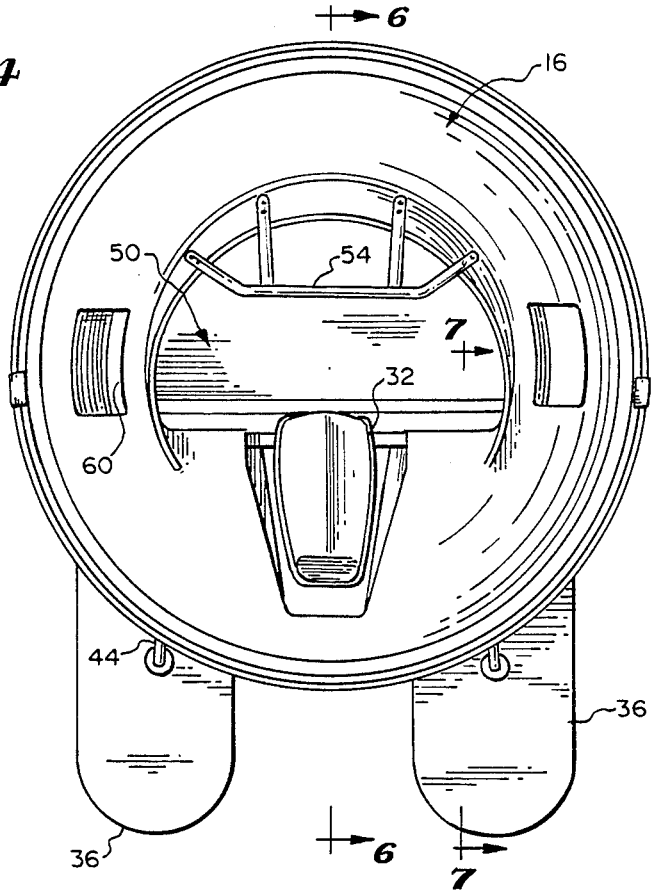
FIG. 4 is a top plan view thereof.

The circular hull 12 has no geometric longitudinal or transverse axis. However, for ease of description herein, the diameter lying along the plane 6—6 in FIG. 4, and representing the direction of forward travel of the boat 10, will be referred to as the longitudinal axis; and the hull diameter perpendicular to the direction of travel will be referred to as the transverse axis.

Figure 5:
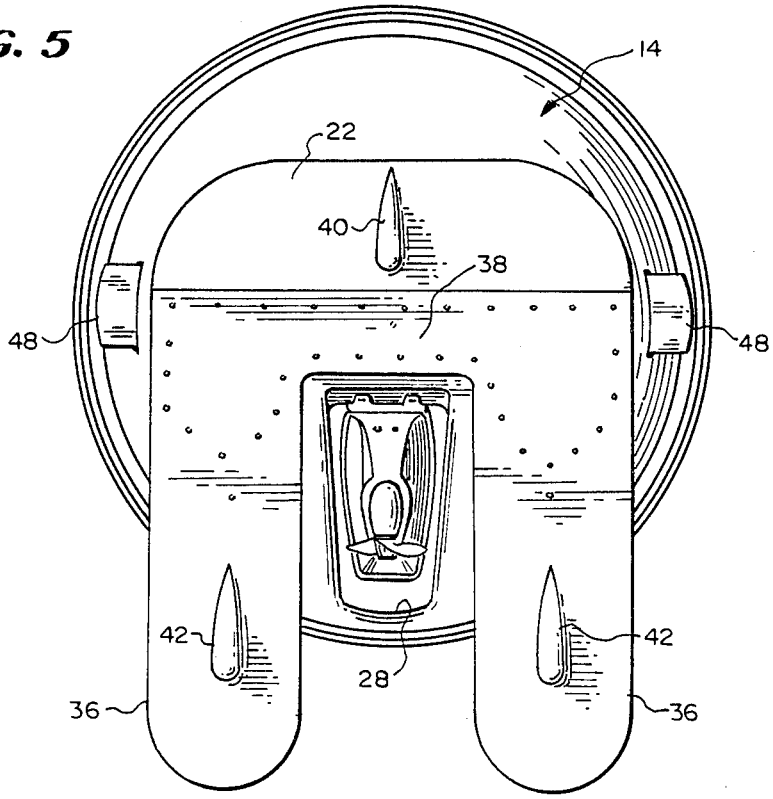
FIG. 5 is a bottom plan view thereof.
Figure 6:
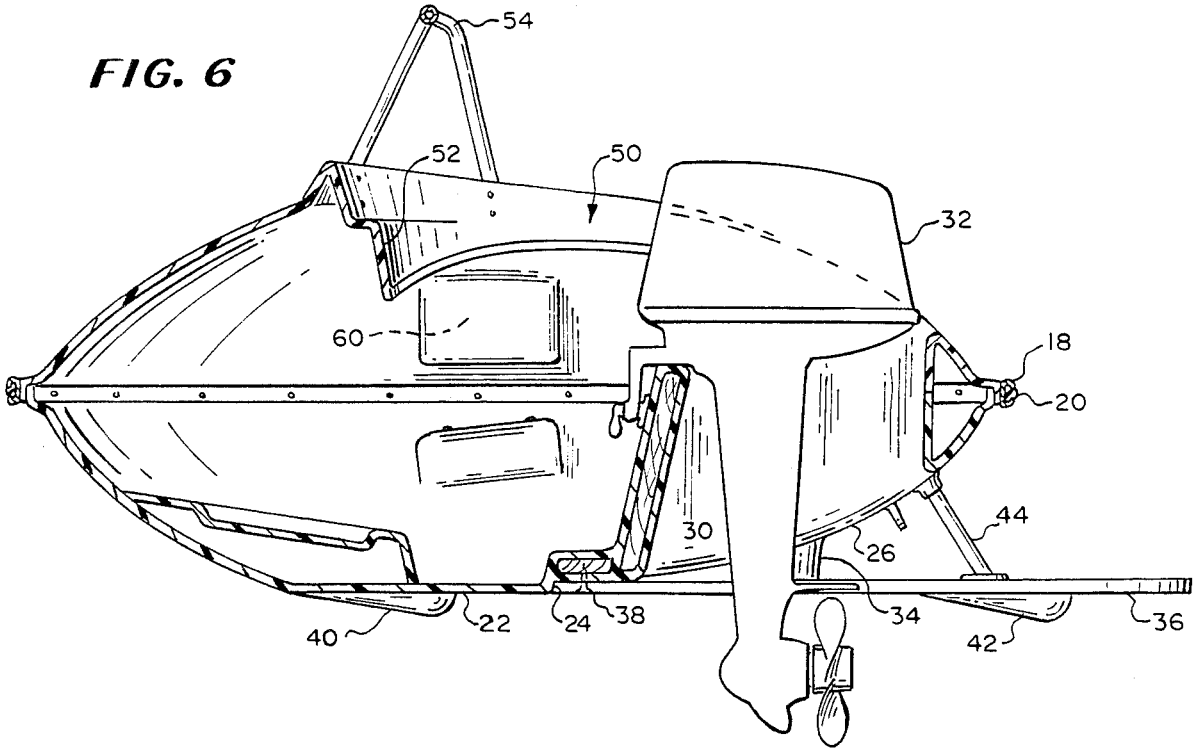
FIG. 6 is a vertical sectional view on the plane of line 6—6 in FIG. 4.

As best seen in FIGS. 5 and 6, the outer surface of the bottom portion 14 comprises a forward planar section 22 which extends rearwardly to provide a shoulder 24 and then merges smoothly into a rear dish-shaped section 26. Bottom portion 14 also defines a motor well 28

Figure 3:
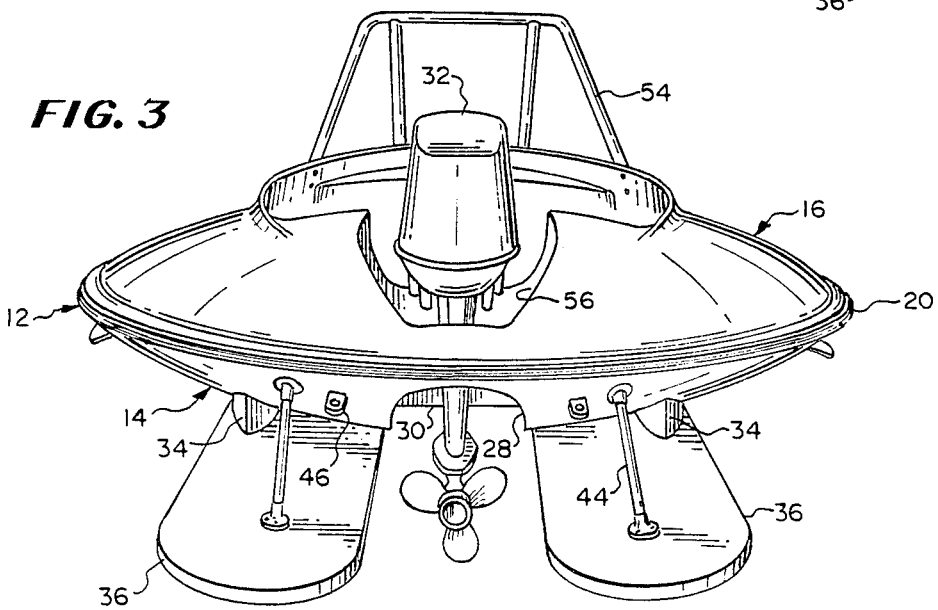
FIG. 3 is a rear perspective view thereof.

(see FIGS. 3 to 5) and an upwardly projecting wall 30 which serves as a mounting plate for a motor means 32 such as an outboard motor.

A pair of transversely spaced support columns 34, 34 depends from the section 26 of the bottom portion 14 and, preferably, are unitary with said bottom portion. A pair of skis 36, 36 is rigidly connected to the support columns 34 and the bottom portion 14. The skis 36 preferably are unitary with a transverse cross member or plate 38 of a plastic material similar to, or the same as, that of the hull 12. The cross member 38 is secured to the hull bottom portion 14 in abutting relationship with the shoulder 24. It will thus be appreciated that the planar section 22, cross member 38 and skis 36 comprise an uninterrupted planing surface which extends longitudinally to the skis as the same project rearwardly of the hull 12. Optional keel members 40 and 42, 42 depend from the planar section 22 and skis 36, respectively, and serve to provide further directional stability to the boat when underway.

Support rods 44, 44 are connected between the rear section 26 and the skis 36 for additional structural support. Eye members such as 46, 46 may likewise be mounted from the rear section 26 for receiving a towing rope for water skiers or the like. A turning fin 48 is rigidly mounted to the freeboard section of hull bottom portion 14 on each side thereof and projects laterally outwardly therefrom at a position lying on the transverse axis of the hull 12. The fins 48 preferably are made of metal plate, e.g., stainless steel, aluminum, or the like, and inclined at a slight angle from the horizontal to provide a negative angle of attack for purposes which will subsequently be described.

Referring now to the deck portion 16, this portion defines a transverse cockpit region 50 which lies on the transverse axis of the hull 12. The cockpit region 50 is defined rearwardly by the rear wall 51 (FIG. 7) and forwardly may include a curved front panel wall 52 (FIG. 6) generally concentric with the circumference of the hull 12. Railing means 54 is mounted on the deck portion 16 at the front of the cockpit region 50.

Deck portion 16 is formed with a motor well access opening 56 in registry with the motor well 28 in the bottom portion 14. A dish-shaped rear deck section 58 is also part of deck portion 16. The motor well 28 and its access aperture 56 lie inwardly of, and do not extend to the circumferential edge of the hull 12. Thus, the motor 32 is positioned in its entirety inwardly of the hull perimeter.

The deck portion 16 comprises further an integrally formed step 60 substantially abeam, i.e., on either lateral side of the cockpit region 50 and lying generally on the transverse axis of the hull 12. The steps 60, 60 thus lie substantially above the turn-assist fins 48. If desired, storage compartments may also be provided in the deck portion 16.

Motor mount means such as cables 62, 62, bracket 64 and anti-shock spring 66 are associated with the bottom portion wall 30 that serves as a pseudo-transom for operationally mounting an outboard motor thereon. Such mounting means may be conventional inasmuch as they permit fore and aft pivoting of the outboard motor, but it is important to note that the operationally mounted motor is fixedly mounted with relation to the longitudinal axis of the hull 12 and plays no role in the steering of the boat. In view of the fixed positioning of the motor drive means, the same could likewise comprise other forms of motors such as a jet drive motor instead of the conventional outboard motor shown.

Figure 7:
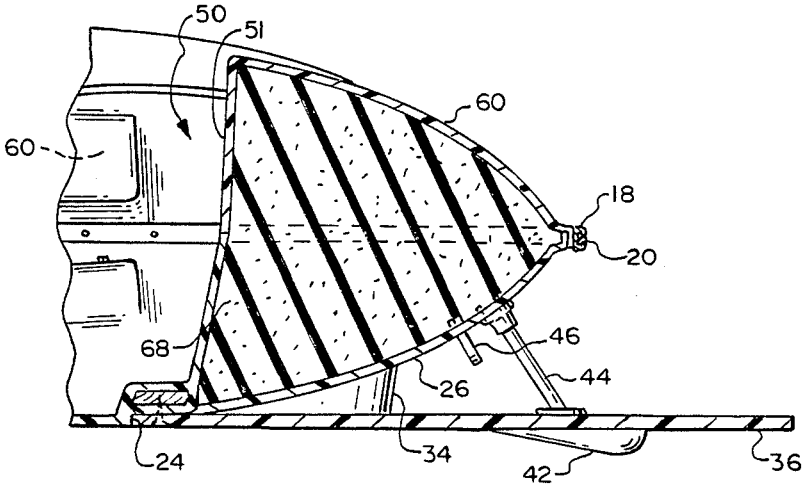
FIG. 7 is an enlarged, fragmentary sectional view on the plane of line 7—7 in FIG. 4.
Figure 8:
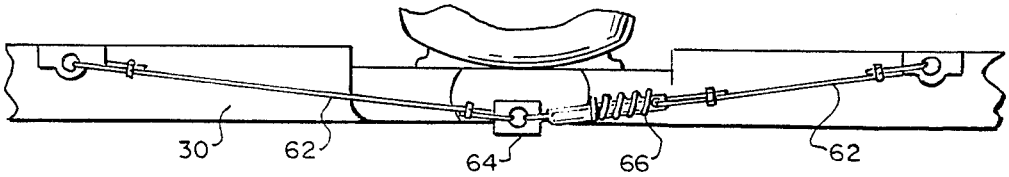
FIG. 8 is a fragmentary rear elevational view showing the motor mounting means.

Referring to FIG. 7, it will be noted that the space between the rear sections 26 and 60 of the hull bottom and deck portions is filled with a foamed packing material 68. In the embodiment illustrated, the packing material 68 comprises polyurethane injected and foamed in situ. Such application provides the material 68 with a substantially water-impermeable skin which prevents the packing from becoming water-logged and renders the boat virtually unsinkable. Any closed pore foam material can be utilized for this purpose.

When the boat is sitting at rest, it will float with the water line below the bump rail 20, the exact water line depending on the weight of the passenger or passengers in the cockpit region 50. If the boat is run at a slow speed, turning may be achieved by the passenger shifting his weight or stepping onto one of the steps 60 so as to engage one of the fins 48. As boat speed is increased, the hull 12 begins to plane and ride primarily on the skis 36. Attainment of planing may be accelerated if the operator leans back as the boat gathers forward speed. At planing speeds, turning is achieved merely by shifting passenger weight in the direction of the turn and over the corresponding ski 36. If a very sharp or abrupt turn is desired, a passenger may shift the weight further or step onto step 60 to cause the associated fin 48 to dip into the water and create a braking action that executes such a turn.

It will be readily appreciated from the foregoing detailed description of the invention and illustrative embodiment thereof that numerous variations and modifications may be effected without departing from the true spirit and scope of the novel concept of the principles of the invention.

What is claimed is:

1. A circular pleasure boat comprising:

dish-shaped bottom and deck members secured together in opposed relationship around the perimeter thereof to provide a circular hull having a longitudinal fore-and-aft axis and a transverse axis;

an amidship cockpit region in said deck member;

a motor well defined by said hull;

motor means operationally mounted in said motor well in fixed alignment with said longitudinal axis;

a pair of transversely space, substantially planar skis rigidly connected to said bottom member and extending longitudinally rearwardly therefrom;

a planar section in said bottom member cooperating with said skis to provide an uninterrupted forwardly extending planing surface with said skis;

opposed fin means associated with said bottom member for assisting in the steering of said boat and each fin means comprising a planar member projecting laterally outwardly from said bottom member on each side thereof and lying along said transverse axis of the circular hull; and step means in said deck member in vertical registry with said fins whereby an operator stepping on said step means while the boat is planing on said skis will cause a fin to dip into water and turn the boat;

said planing surface acting to elevate said hull substantially above water surface when sufficient forward speed is achieved by the boat whereby said boat planes on said skis and steering of the boat is effected by the shifting of weight of boat operator over one or the other of said skis.

2. A circular pleasure boat according to claim 1 wherein said skis are unitary with a transverse cross-member at the forward ends thereof, said cross-member being secured to said bottom member and cooperating therewith to provide said uninterrupted planing surface.

3. A circular pleasure boat according to claim 2 further provided with a pair of transversely spaced support columns depending from said bottom member, each said ski being secured to one of said support columns.

4. A circular pleasure boat according to claim 3 wherein said motor means is an outboard motor, and wherein a motor mounting means is provided operationally mounting said outboard motor in a fixed position relative to the longitudinal axis of the hull, whereby said motor is non-functional for the steering of said boat.

5. A circular pleasure boat according to claim 3 provided with a longitudinal keel on said bottom member planar section and with a longitudinal keel on each of said skis.

* * * * *